United States Patent [19]

Seaberg

[11] 4,161,256

[45] Jul. 17, 1979

[54] FLUID POWER SYSTEM HAVING MULTIPLE, SEPARATELY CONTROLLABLE DOUBLE-ACTING FLUID MOTORS AND REDUCED NUMBER OF FLUID CONDUITS

[75] Inventor: Richard D. Seaberg, Vancouver, Wash.

[73] Assignee: Cascade Corporation, Portland, Oreg.

[21] Appl. No.: 839,179

[22] Filed: Oct. 4, 1977

[51] Int. Cl.[2] ..... B66F 9/18

[52] U.S. Cl. ..... 414/620; 91/526; 91/531; 414/621

[58] Field of Search ..... 214/653, 652; 91/413, 91/414, 526, 531

[56] References Cited

U.S. PATENT DOCUMENTS

| | | | |
|---|---|---|---|
| 3,395,732 | 8/1968 | Comfort | 214/653 X |
| 3,692,198 | 9/1972 | Lake | 214/653 |
| 3,851,566 | 12/1974 | Herrmann | 91/414 X |

FOREIGN PATENT DOCUMENTS

| | | | |
|---|---|---|---|
| 717358 | 10/1954 | United Kingdom | 214/653 |

*Primary Examiner*—Albert J. Makay
*Assistant Examiner*—George F. Abraham
*Attorney, Agent, or Firm*—Chernoff & Vilhauer

[57] ABSTRACT

A fluid power system having a source of pressurized fluid serving a plurality of separately controllable double-acting fluid motors. A network of selectively operable control valves and hydraulic lines serving the motors is provided, selective ones of the lines being operatively jointly connected to one another and to the control valves in such a way as to reduce the number of hydraulic lines serving the motors to less than the normal number while retaining the separate controllability of the motors. Several different embodiments of the invention are disclosed.

17 Claims, 5 Drawing Figures

FLUID POWER SYSTEM HAVING MULTIPLE, SEPARATELY CONTROLLABLE DOUBLE-ACTING FLUID MOTORS AND REDUCED NUMBER OF FLUID CONDUITS

BACKGROUND OF THE INVENTION

The present invention relates to improvements in fluid power systems having multiple, separately controllable double-acting fluid motors, and more particularly to such systems used for powering multiple mechanical functions of lift truck load handling attachments.

Double-acting fluid motors, which as used herein broadly include such devices as bidirectional cylinder and piston assemblies and bidirectional rotary fluid motors, conventionally require a pair of hydraulic or pneumatic lines connecting each motor with its respective control valve so that the control valve may direct pressurized fluid respectively to one or the other of the lines to actuate the motor in either of two directions, the line not receiving pressurized fluid serving to exhaust fluid from the motor. When multiple separately controllable double-acting fluid motors are utilized in a fluid power system, each performing a separate function, each motor conventionally has its own pair of fluid lines interconnecting it with its own separate control valve. Thus the number of fluid lines interconnecting the control valves with such separately controllable double-acting motors is normally twice the number of motors. Such separately controllable motors are to be distinguished from motors which operate in tandem in a cooperative manner to perform a single function, such as a pair of double-acting hydraulic cylinders which extend or retract in unison to raise or lower a boom, or the like. Such tandem motors are not separately controllable since they do not perform separate functions, and therefore may be connected in parallel through only one pair of fluid lines to a single control valve.

The multiplicity of fluid lines normally required by multiple, separately controllable double-acting fluid motors causes substantial problems in certain fluid power applications, notably where the multiple motors are remote from the control valves and more through extended distances with respect to the valves. For example in an industrial lift truck the control valves would normally be mounted on the main body of the truck within reach of the operator, while the various separately controllable double-acting motors might be mounted on a load handling attachment which reciprocates vertically through a substantial distance on the lift truck mast. Load handling clamp attachments for lift trucks, for example, have two or three separately controllable double-acting hydraulic motors performing such diverse functions as clamping, rotating and side-shifting of the load. Under conventional practice, three such separately controllable fluid motors would require six fluid lines extending from three valves on the lift truck body to the vertically reciprocating attachment. Because of the substantial movement of the attachment with respect to the valves, such lines would have to be extensible and retractable, requiring hose reels capable of handling six lines. While hose reels capable of serving such a large number of lines might be used, the bulk and space requirements of both the reels and the lines are unacceptable in light of the limited space available for such items on the mast of a lift truck, and the impingement of such items upon the visibility of the lift truck operator.

One solution to this problem, limited only to the specific application of a particular type of clamp having two double-acting fluid motors, has been proposed in Lake U.S. Pat. No. 3,692,198 wherein a means of serving the two motors with less than the normal number of extensible and retractable fluid lines between the motors and the control valves is disclosed. However Lake's arrangement of control valves in parallel with one another requires three three-position control valves to operate the various functions and is adaptable to control only two separately controllable double-acting hydraulic motors. Both a simplification in the control valve arrangement and, more important, an adaptability to control more than two separately functioning double-acting hydraulic motors, is required for certain important types of lift truck load handling attachments.

An alternative solution to the foregoing problem of multiplicity of fluid lines has been known for many years. In this alternative, which is of more generalized application than Lake's specific two-motor application, the problem is solved not by reducing the number of lines between motors and control valves but rather by mounting some of the control valves so as to move in unison with the motors, such as upon the vertically reciprocating lift truck load handling attachment. Control valves which move in unison with a load handling attachment can all be jointly connected to the main body of a lift truck by merely a single pair of extensible and retractable fluid lines for which hose reels are required. However such control valves must be controlled electrically by solenoid operation because of their remote location with respect to the operator. This electrical control requires an extensible and retractable multi-conduit electrical cable extending between the lift truck body and the load handling attachment. While the electrical cable is much more compact than the equivalent number of hydraulic lines which would otherwise be required, the constant flexing of the metal strands in the electrical cable in response to the movement of the load handling attachment causes work-hardening and resultant breakage and short-circuiting of the cable, resulting in troublesome, recurrent service problems.

Accordingly an alternative solution which does not require extensible and retractable electrical lines and cables, which has a more simplified control valve arrangement, and which is adaptable to any number of separately controllable double-acting hydraulic motors, is required.

SUMMARY OF THE INVENTION

In response to the foregoing requirements, the present invention utilizes both a novel control valve arrangement and a novel interconnection of fluid lines serving three or more separately controllable double-acting fluid motors.

The novel control valve arrangement preferably used in the system is an unusual series arrangement of control valves. It has, of course, been common practice in fluid power circuits having separately controllable double-acting motors to connect both of the output lines of a first control valve to a second control valve. (The control valves of double-acting fluid motors conventionally contain at least a pair of "output lines", one for directing pressurized fluid to the motor(s) and one for exhausting fluid from the motor(s) simultaneously, the functions of the "output lines" being reversible depending upon the position of the control valve; as used herein this is the meaning of the term "output lines".) The conventional series arrangement of valves selectively connects both of the output lines of the first control valve simultaneously to any of several alternative flow paths depending upon the position of the second valve, so as to operate different alternative motors. Such conventional series arrangements are exemplified by the previously described electrical solenoid valve systems mounted on lift truck load handling attachments which direct a pair of output lines extending from a control valve on the main body of the lift truck selectively to different motors on the attachment.

The unusual series connection of valves utilized in the present invention is unique, in the application of a control valve system for operating double-acting fluid motors, because the second valve, rather than being connected to both of the output lines of the first control valve, is instead connected in series with only one of the first valve output lines. In the present invention the second valve selectively connects the one output line to either of two alternative conduits, each of the conduits being connected to a separate double-acting fluid motor. The other output line of the first valve, to which the second valve is not connected, is jointly connected to each of the two motors independently of the second valve. In this way only three separate fluid lines need extend from an assembly of two series-connected control valves to a pair of separately controllable double-acting motors. The addition of a third control valve permits a third separately controllable double-acting motor requiring the addition of only one more such fluid line, and so on. The second valve may be manually operated or, for easier operation simultaneously with the first valve, may be electrically, pneumatically or hydraulically operated. Electrical solenoid operation in this case does not have the disadvantages of the previously discussed solenoid-operated valve system, since in this case the second valve is not movable with the motors and no extensible and retractable electrical cable is required.

The second basic area of novelty concerns the fluid circuit interconnection of three or more separately controllable double-acting fluid motors. Each of the three double-acting fluid motors has a pair of fluid lines operatively connected separately to it. However, in accordance with the present invention, the number of fluid lines connecting the three motors to the assembly of control valves must be less than six. In the present invention this result is accomplished by operatively connecting one fluid line from each of two of the motors to the control valve assembly jointly with a fluid line of the third motor, the remaining line of each of the two motors being connected to the valve assembly separately from the fluid lines of the other motors. Each joint connection of a line of one of the first two motors with a line of the third motor results in a savings of one fluid line normally necessary to connect the control valve assembly to the motors. Accordingly the number of fluid lines extending from the control valve assembly can be reduced from the normal six to four. Because of the foregoing specific joint connection arrangement utilized, separate controllability of the three double-acting motors can be retained despite the joint connection of lines. This is because the actuation of a particular double-acting fluid motor requires the cooperation of flow in both of its lines. Accordingly, even though pressurized fluid is applied jointly to more than one motor at any particular time through the jointly connected lines, the fact that the other lines of such motors are not jointly connected to one another makes it possible to exhaust one but not the other(s), thereby permitting actuation only of the motor having the exhausted line. This fluid interconnection circuitry for three or more double-acting fluid motors is compatible with both the unique series-connected control valve arrangement described previously, or with a more conventional arrangement of parallel connected control valves.

The joint interconnection of selected fluid lines of different separately operable double-acting fluid motors, in accordance with the present invention, raises a number of potential circuit malfunction problems which may require elimination depending upon the particular application of the fluid system. One of the potential problems involves a situation where the actuation of a particular motor requires that fluid be exhausted through a fluid line which is jointly connected to a fluid line of another motor. The exposure of the jointly connected fluid line of the nonactuated motor to exhaust can, if such motor is loaded so as to exert pressure against fluid in the line, cause exhaust of fluid from the nonactuated motor as well with resultant cavitation of that motor and possible release of the load. When this potential problem is presented, it can be obviated by providing a pilot-operated valve in such line between the motor and the junction with the other jointly connected line, such pilot-operated valve preventing exhaust of fluid from the line unless a sufficient positive pressure is sensed in the other line of the motor.

Although in the opposite case, where the jointly connected lines are both exposed to pressurized fluid, separate control of the motors can be maintained by the separate exhaust control of the second line of each respective motor as mentioned previously, there may be some instances where it is undesirable for a nonactuated motor to receive even a pulse of pressure from its jointly connected line. For example, motors which actuate a pair of load handling clamp arms of a lift truck load clamp attachment should not be exposed inadvertently to such pressure pulses since such pulses may cause a slight or momentary increase or relief of clamping pressure with the result that a load might be damaged or dropped. In such case a vented pilot-operated valve, also located between the respective motor and the junction of the jointly connected lines, can be employed to prevent the supply of pressurized fluid through such line unless the second line of the motor has been vented to permit the exhaust of fluid therefrom.

It is accordingly a principal objective of the present invention to provide a fluid power system for controlling three or more separately controllable double-acting fluid motors which requires less than the normal number of fluid lines extending from the control valves toward the motors.

It is a further principal objective of the invention to provide, for the control of multiple separately operable double-acting fluid motors, a first control valve having at least a pair of output fluid lines and a second control valve operatively connected in series with one of the output lines, but not the other, of the first valve, such series-connected valves being controllable separately from, and simultaneously with, one another.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
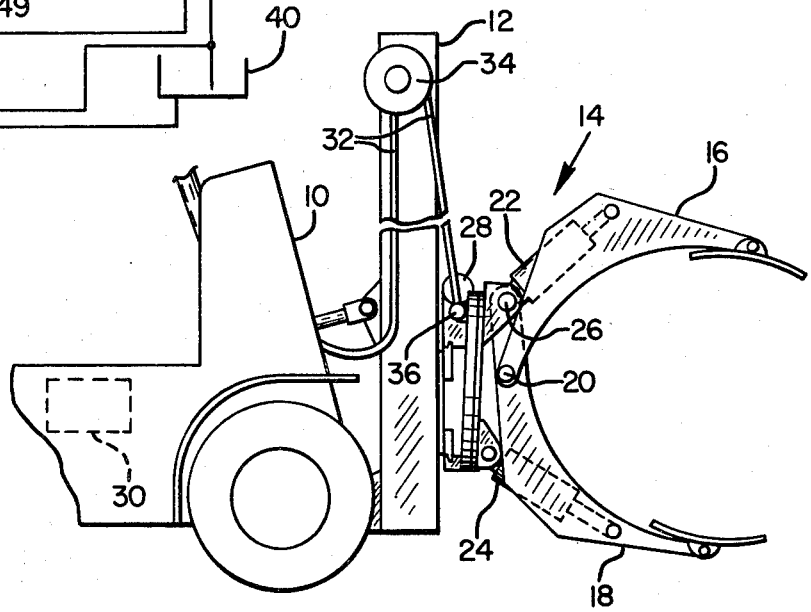
FIG. 1 is a partial side view of a lift truck having an exemplary load handling attachment on the front thereof suitable for application of the fluid power system of the present invention.

A typical exemplary application of the present invention is shown in FIG. 1 wherein a lift truck having a main body 10 has a load-fitting mast 12 mounted at the forward end thereof with a load handling clamp attachment 14 movably mounted on the mast 12 so as to reciprocate selectively upwardly or downwardly with respect to the main body 10. The attachment 14 may be of any of a number of different types, that shown in FIG. 1 being a paper roll-handling clamp having a pair of clamp arms 16 and 18 which open and close relative to one another about a pivot axis 20 in response to the selective retraction and extension in unison of a pair of tandem, side-by-side double-acting piston and cylinder assemblies such as 22. For convenience the tandem piston and cylinder assemblies 22 will be referred to hereafter collectively as motor 22 since they function together as a single motor. Also included in the illustrative load handling attachment 14 is a double-acting piston and cylinder assembly 24 (hereafter motor 24), controllable separately from the motor 22, which selectively swings the clamp arms laterally back and forth about a pivot 26 so as to thereby shift the position of the load. Finally, a bidirectional hydraulic motor 28 controllable separately from the motors 22 and 24 is provided for selectively rotating the clamp arms about an axis extending forwardly generally longitudinally of the lift truck.

Because the entire load handling clamp 14, including the various double-acting fluid motors 22, 24 and 28, reciprocates vertically with respect to the main body 10 of the lift truck, and because the source of pressurized fluid for operating the attachment 14, as well as the control valve assembly 30 for controlling the various fluid motors, are located on the main body 10, extensible and retractable fluid lines such as 32 must extend between the main body 10 and the load handling attachment 14. Extension and retraction of the lines 32 is accomplished by means of a pair of hose reels such as 34, mounted either on the main body 10 or on the mast 12, capable of storing coiled lengths of the lines 32 and permitting the lines to be pulled from or retracted into the reels 34 in response to the vertical reciprocation of the load handling attachment 14.

It should be understood that the structure of the particular load handling attachment 14 depicted in FIG. 1, as well as the use of hose reels such as 34 for purposes of extension and retraction of fluid lines, are presented simply as an example of an application of the fluid power system of the present invention, it being desired to illustrate an exemplary mechanism utilizing at least three separately controllable double-acting fluid motors which, in operation, more through a substantial distance relative to their fluid control valve assembly thereby necessitating extensible and retractable fluid lines interconnecting the valve assembly with the motors. No claim of invention is made herein to the specific structure of the load handling attachment 14 shown in FIG. 1, such particular mechanical structure having been the invention of others.

As discussed in the Summary of the Invention, it is necessary in the present invention to operatively jointly interconnect certain fluid lines leading to different ones of the respective double-acting fluid motors. In keeping with the objective of the invention to minimize the number of extensible and retractable lines 32, the connecting means which interconnect these lines are mounted in association with the load handling attachment 14 at fluid junctions such as 36 mounted upon the attachment so as to reciprocate vertically in unison with the attachment.

FIG. 2 EMBODIMENT

Figure 2:
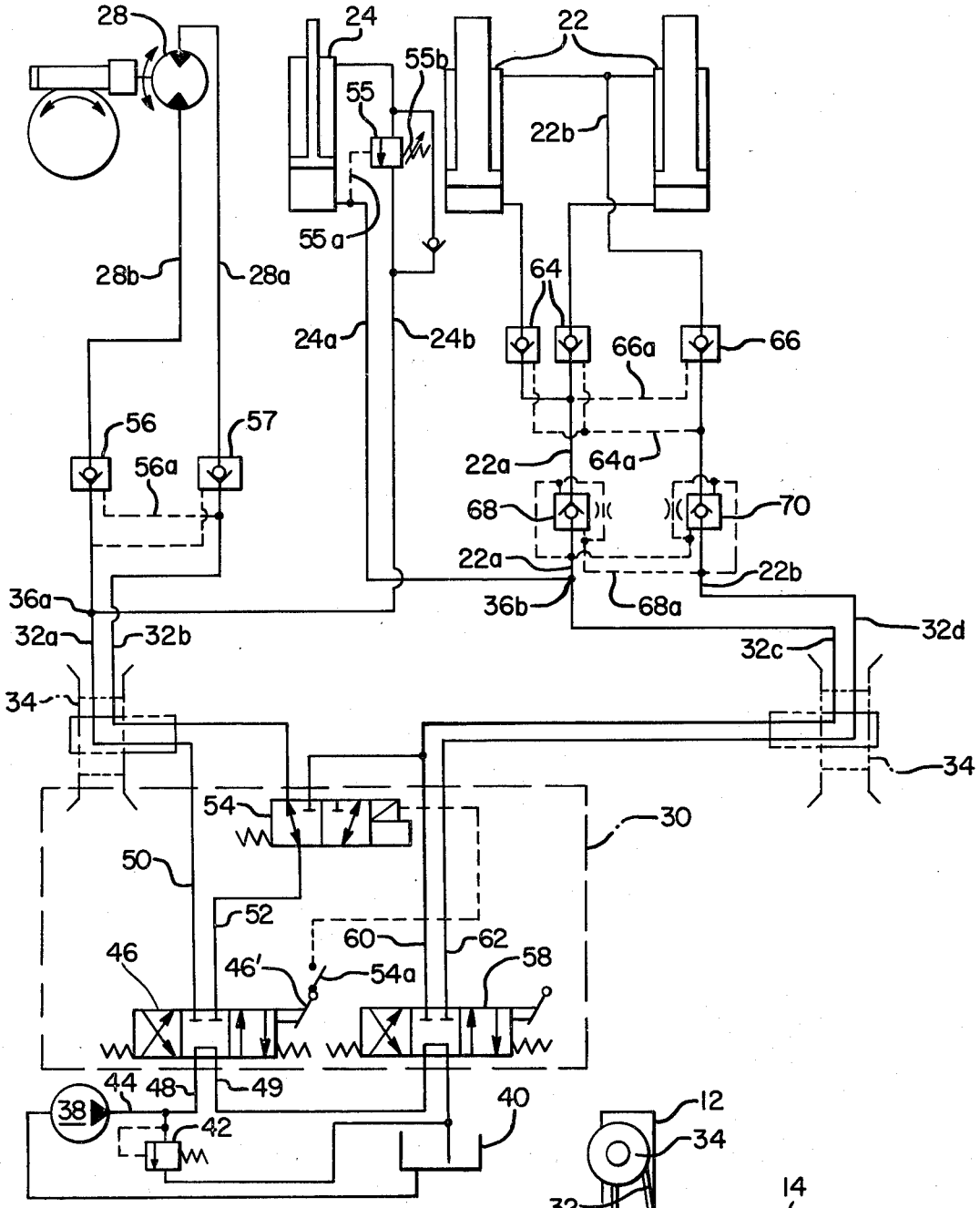
FIG. 2 is a detailed schematic drawing of an exemplary fluid power system arranged in accordance with the present invention.

FIG. 2 is a detailed schematic of an exemplary fluid power system utilizing all of the novel features of the present invention applicable to the operation of any mechanism having three separately controllable double-acting fluid motors, and specifically those utilized in the structure of FIG. 1. In the embodiment of FIG. 2 (as in all of the alternative embodiments of FIGS. 3–5) a source of pressurized fluid such as a pump 38, conventionally mounted on the main body 10 of the lift truck or other equipment and driven by the engine thereof, is provided drawing its fluid from a standard reservoir such as 40 and having a conventional pressure relief valve 42. The fluid control valve assembly 30 receives pressurized fluid from the source pump 38 through a line 44. The control valve assembly 30 comprises a control valve 46 having an input line 48 for receiving pressurized fluid and an exhaust line 49 for exhausting fluid to the reservoir 40, and respective first and second output lines 50 and 52 for selectively delivering the pressurized fluid and exhausting fluid simultaneously depending upon the position of the valve 46. It will be understood that in either of the two operative positions of valve 46, one of the output lines conducts pressurized fluid to the motor being activated while the other output line simultaneously exhausts fluid from that motor, the function of each line being reversible depending upon the position of the valve 46.

A selectively operable fluid control valve 54 is also provided as part of the valve assembly 30, the valve 54 being operatively connected in series with output line 52 of valve 46, but not output line 50. The two valves 46 and 54, in cooperation with one another, control the actuation of double-acting fluid motors 28 and 24. It will be noted that each of these two fluid motors has a respective pair of fluid lines **28*a*, b and 24*a*, b connected separately from one another to the respective motor. The lines 24*a* and 28*a* are each connected, also separately from one another, to the control valve 54, while the fluid lines 24*b* and 28*b* are interconnected at a junction 36*a* and thereby jointly connected to the output line 50 of control valve 46. With this arrangement of series-connected valves 46 and 54 and fluid lines serving the motors 24 and 28, the motors 24 and 28 can each be actuated separately from one another and in either direction. For example, if valve 46 is moved in either of its two directions from the center unactuated position shown in FIG. 2, one of output lines 50 and 52 will receive pressurized fluid from the pump 38 while the other line will be exhausted to the reservoir 40. In the normal position of valve 54 as shown, fluid lines 28***a* and 28*b* of motor 28 will be connected to the output lines 50 and 52, and the motor 28 will be actuated in one direction or the other depending upon the position of the valve 46. Meanwhile line 24*b* of motor 24 will also be exposed to output line 50 due to the joint connection of line 24*b* with line 28*b* at juncture 36*a*. However the other line 24*a* of the motor 24 will be connected to neither of the lines 50 and 52, but rather will be blocked by the valve 54 in the normal position shown. Accordingly, even though line 24*b* may be exposed to pressurized fluid from output line 50, no corresponding exhaust of fluid through line 24*a* will be permitted. Accordingly motor 24 will remain unactuated while motor 28 is actuated. Conversely if output line 50 is exhausting fluid, motor 24 will likewise remain unactuated while motor 28 is activated, also because of the blockage of line 24*a*. Even if an external force tending to exhaust fluid through line 24*b* is imposed upon the motor 24 in this latter case, the presence of a pilot-operated counterbalance valve 55 interposed in line 24*b* between the motor 24 and the junction 36*a* will prevent the exhaust of fluid through line 24*b* whenever the pressure in line 24*a*, as sensed through pilot line 55*a*, is below a predetermined pressure determined by the setting of the counterbalance spring 55*b*, although the exhaust of fluid through jointly connected line 28*b* of motor 28 is simultaneously permitted.

If control valve 54 is shifted to its second position, opposite to that shown in FIG. 2, the control of motor 24 in either direction, depending upon the position of valve 46, can likewise be accomplished without the actuation of motor 28. This is due to the fact that in the second position of valve 54, lines 24*a* and 24*b* are now connected to output lines 52 and 50 respectively of valve 46, while line 28*a* of motor 28 is blocked by the valve 54. As before, the blockage of the line 28*a* prevents the actuation of motor 28 even though pressurized fluid is available through jointly connected line 28*b*. Conversely, no exhaust of fluid from the motor 28 through line 28*b* is permitted even though fluid is being exhausted through jointly connected line 24*b* of motor 24 because of the interposition of pilot-operated check valve 56 in the line 28*b* between the motor 28 and the junction 36*a*, which prevents the exhaust of fluid through line 28*b* unless a sufficient positive pressure is sensed in line 28*a* through pilot line 56*a* to unseat the check valve 56. Depending upon the application, a companion pilot-operated check valve 57 can be provided in the line 28*a* to ensure against such contingencies as possible leakage loss through the valves 54 and 46. It will be appreciated that the pilot-operated check valves 56 and 57 are thus functionally equivalent to the pilot-operated counterbalance valve 55 discussed previously.

Valve 54 could be operated manually. However, because of the need to operate valves 46 and 54 simultaneously with, and yet separately from, one another it is preferable in order to facilitate operation that valve 46 be manually operable by means of a lever such as 46' and that valve 54 be operated by an electrical, pneumatic or hydraulic servomechanism such as an electrical solenoid as shown schematically, with the solenoid actuating switch 54*a* being mounted upon the manual control lever 46' of the valve 46.

It will be noted that, in the previous discussion, the separate control of both double-acting motors 24 and 28 is accomplished with the utilization of only three fluid lines 32*a*, 32*b* and 32*c* passing through hose reels 34. The third separately controllable double-acting motor 22 can be added with the addition of only one more extensible and retractable fluid line 32*d* and one more fluid control valve 58. The motor 22 is served by a pair of fluid lines 22*a* and b connected separately to the motor for simultaneously feeding and exhausting fluid during actuation of the motor 22. It will be noted that the line 22*a* is jointly connected with the line 24*a* of the motor 24 at a junction 36*b* such that the two lines 22*a* and 24*a* are operatively jointly connected to the valve assembly 30. Conversely, the other line 22*b* is operatively connected to the valve assembly 30 separately from the fluid lines of any of the other motors by virtue of its individual connection to the third selectively operable valve 58. The output lines 60 and 62 of the valve 58 conduct pressurized fluid and exhaust fluid simultaneously, depending upon the position of the valve 58, in the same manner as previously described with respect to output lines 50 and 52 of valve 46. Thus if line 22*a* is exposed to pressurized fluid from output line 60, the motor 22 is extended and fluid is exhausted through line 22*b* and output line 62. Even though line 24*a*, in such case, is simultaneously exposed to the pressurized fluid because of its interconnection with line 22*a*, motor 24 remains unactuated because line 24*b* is blocked by valve 46. Conversely, when line 22*b* receives pressurized fluid from line 62, fluid is exhausted through line 22*a* and line 60.

If line 22*a* is exposed to pressurized fluid without the exposure of line 22*b* to exhaust, which occurs in one direction of actuation of motor 24, then motor 24 is actuated while motor 22 remains unactuated since line 22*b* is blocked by valve 58. Conversely, if line 22*a* is exposed to exhaust by the actuation of motor 24 in the opposite direction, motor 24 is actuated while motor unit 22 remains unactuated, again because of the blockage of line 22*b*. In this case, even under external load applied to motor 22, no exhaust of fluid from motor 22 occurs through line 22*a* because of the provision of pilot operated check valves 64 in the branches of line 22*a* which prevent the exhaust of fluid from motor 22 whenever the pressure sensed through pilot line 64*a* in line 22*b* is below a predetermined pressure due to the blockage of line 22*b* by valve 58. A similar pilot operated check valve 66, acting through pilot line 66*a* sensing the pressure in line 22*a*, may be used to prevent any inadvertent exhaust of fluid through line 22*b* due to leakage in valve 58 or other causes such as broken lines. It will be appreciated that pilot operated check valves such as 64 are particularly necessary in a double-acting motor such as 22 which controls the clamping pressure between clamp arms such as 16 and 18, since even a small release of fluid pressure may cause the load to slip.

A pilot operated check valve or counterbalance valve could be provided in line 24*a* of motor 24 since it is theoretically conceivable that fluid could be exhausted through line 24*a* while fluid is being exhausted through line 22*a* pursuant to the retraction of the motor 22. However, in the particular mechanism illustrated in FIG. 1, no exterior force will be present tending to retract the motor 24 when motor 22 is being retracted, and accordingly in this particular application no such pilot operated valve is necessary in line 24a.

Because of the high degree of accuracy in control necessary for a clamping motor such as 22, it is desirable to prevent inadvertent positive pressure pulses in the fluid lines leading to the motor as well as prevent inadvertent fluid exhaust. Accordingly a pair of vented pilot operated check valves 68 and 70 respectively are also provided in fluid lines 22a and 22b respectively. Line 22a is particularly susceptible to the application of unwanted fluid pressure because of its joint connection at junction 36b with line 24a of motor 24. Accordingly, to prevent inadvertent fluid pressure pulses through line 22a which might cause an increase in the clamping pressure and thereby damage the load, the vented pilot operated check valve 68 prevents the passage of fluid through line 22a toward the motor 32 whenever the pressure of fluid in the opposite line 22b, as sensed through pilot line 68a, exceeds a predetermined pressure indicating that the fluid line 22b is not open to exhaust. Since the vented pilot operated valve 68 is located in line 22a between its junction with line 24a and the motor 22, valve 68 does not prevent the flow of pressurized fluid into line 24a during actuation of the motor 24. Vented pilot operated valve 70 operates in a manner similar to valve 68 to prevent pressure pulses which might tend to reduce the clamping pressure.

FIG. 3 EMBODIMENT

Figure 4:
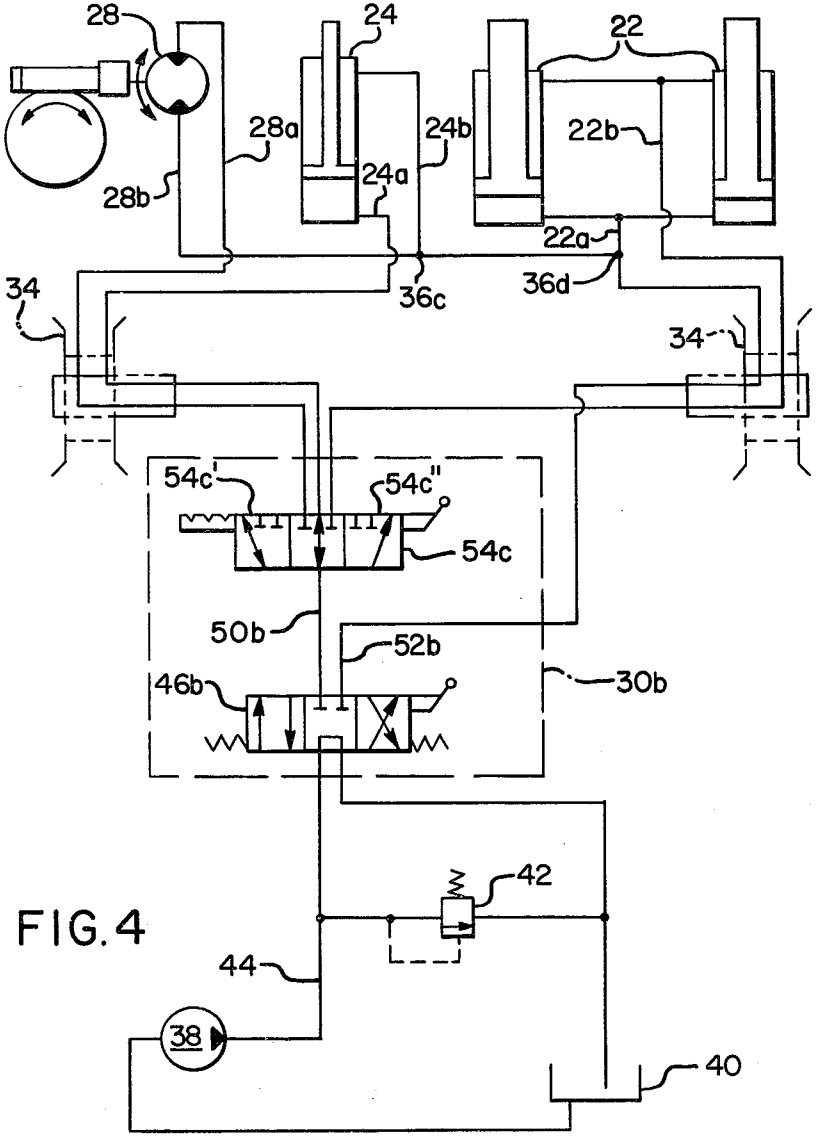
FIG. 4 is a simplified schematic diagram showing a third embodiment in accordance with the invention.
Figure 3:
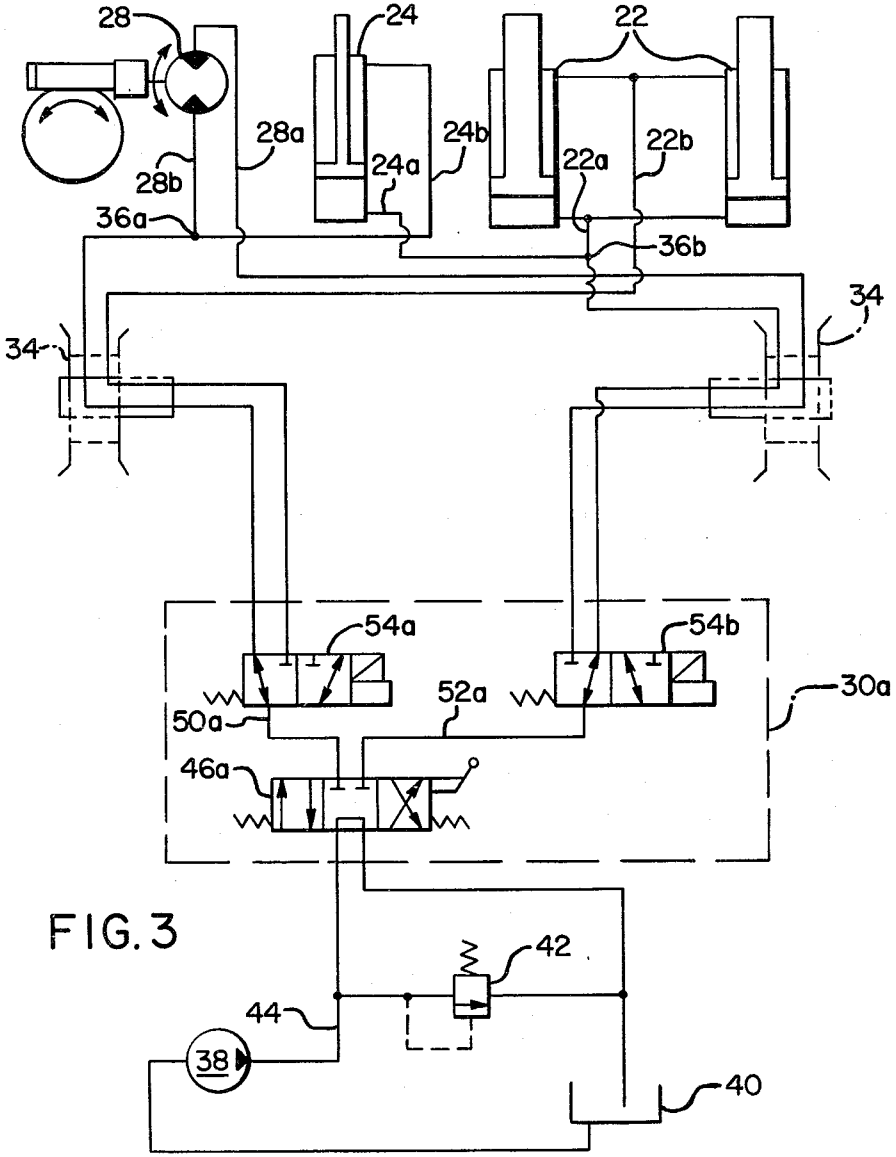
FIG. 3 is a simplified schematic diagram showing a second embodiment of a fluid power system in accordance with the invention.
Figure 5:
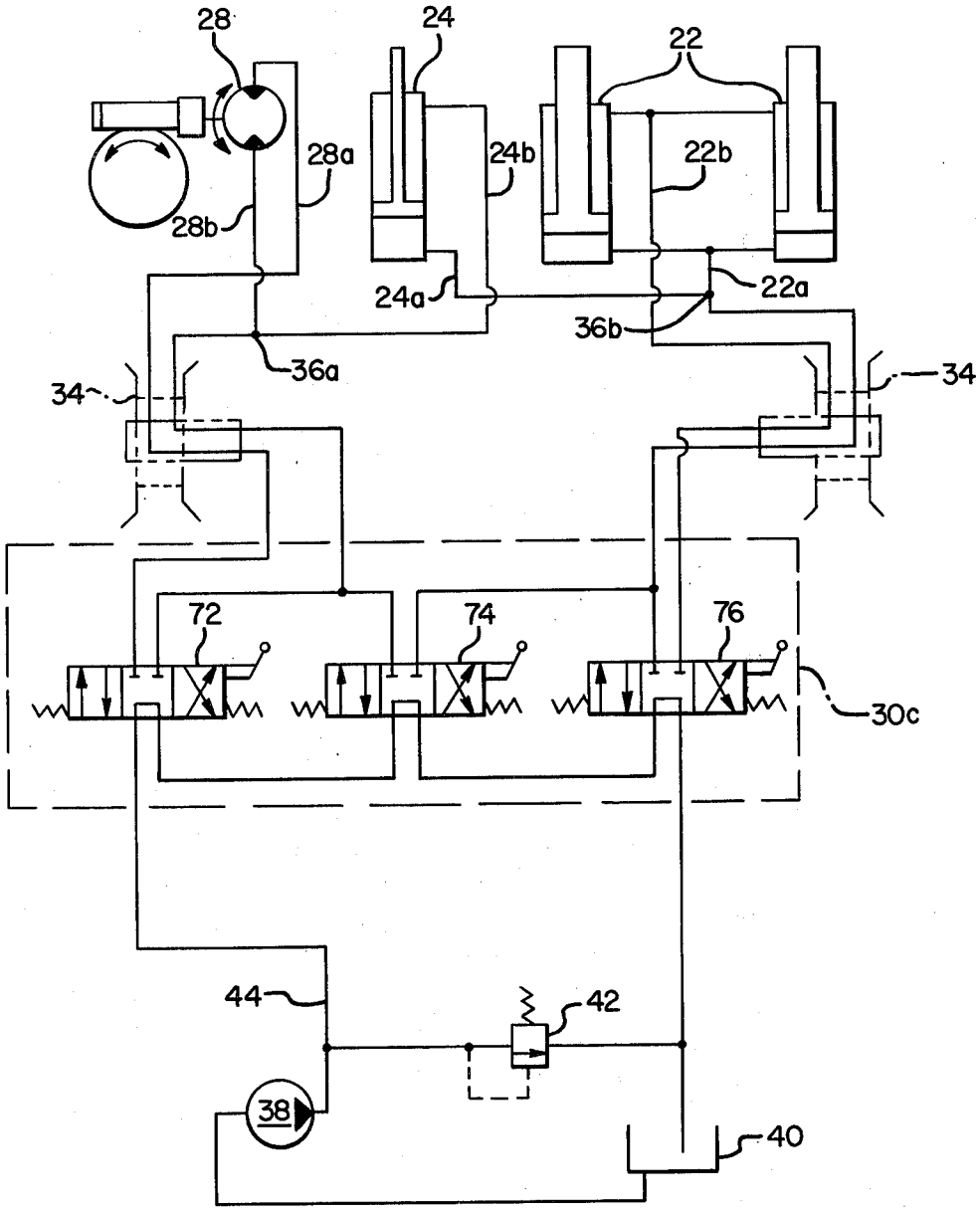
FIG. 5 is a simplfied schematic diagram showing a fourth embodiment in accordance with the invention.

FIGS. 3, 4 and 5 are simplified schematic drawings showing various alternative arrangements of the control valve assembly and fluid lines adapted to accomplish the same purpose of controlling separate motors such as 22, 24 and 28 by means of a reduced number of extensible and retractable fluid lines. For simplicity, the counterbalance valves, pilot operated check valves and vented pilot operated check valves shown in FIG. 2 have been removed in these figures, it being understood however that such valves would be applicable to FIGS. 3, 4 and 5 in the same manner as in FIG. 2.

FIG. 3 depicts an alternative embodiment of the invention in which the arrangement of valve assembly 30a differs substantially from that of valve assembly 30 of FIG. 2. However, like the embodiment of FIG. 2, only four extensible and retractable fluid lines extend from the valve assembly 30a over the reels 34 to the three separately controllable double-acting motors 22, 24 and 28 respectively. Also, it will be noted that the lines 28b and 24b, and the lines 24a and 22a, are interconnected at junctions 36a and 36b respectively in the same manner as in FIG. 2. That is, like the embodiment of FIG. 2, each of motors 28 and 22 respectively has one of its fluid lines, 28b and 22a respectively, connected to the valve assembly 30a jointly with a respective different fluid line 24b or 24a of motor 24, and each motor 28 and 22 has the other of its fluid lines, 28a and 22b respectively, connected to the valve assembly 30a separately from the fluid lines of the other separately controllable motors.

It will be noted that the valve assembly 30a of FIG. 3 still utilizes the unique series arrangement of control valves wherein a respective separately operable solenoid-operated valve is interposed in series with one of the output lines 50a and 52a of valve 46a. In the embodiment of FIG. 3, two such series-connected solenoid valves 54a and 54b respectively are utilized, each interposed in a different output line and each having a pair of fluid lines from each of a pair of separately controllable motors connected separately thereto, while the jointly connected lines of the same pair of motors are jointly connected to the other output line of the valve 46a. For example valve 54b, interposed in output line 52a, is connected to motors 28 and 24 substantially similarly to the manner that valve 54 is connected to those motors in FIG. 2, in that lines 28a and 24a are connected to valve 54b separately from one another, while the jointly connected lines 28b and 24b are jointly connected to the opposite output line 50a of valve 46a. Likewise, with respect to valve 54a interposed in output line 50a, lines 24b and 22b of motors 24 and 22 respectively are connected separately from one another to valve 54a, while jointly connected lines 24a and 22a of the pair of motors 24 and 22 are connected jointly to the other output line 52a of valve 46a.

In this embodiment the direction of operation of all of the bidirectional motors 22, 24 and 28 is determined by the position of valve 46a, and the identity of the particular motor being actuated is determined by the combined positions of valves 54a and 54b. For example, with valves 54a and 54b in their normal positions shown, the manipulation of valve 46a in one direction or another will actuate only motor 24, since at least one line of each of the other two motors 28 and 22 will be blocked. If valve 54b is moved to its second position, then only motor 28 will be actuated, lines 24a, 22a and 22b being blocked. Thus if valve 54a remains in its normal unactuated position as shown in FIG. 3, valves 46a and 54b cooperate with one another to actuate either motor 28 or motor 24 selectively, substantially similarly to the manner in which valves 46 and 54 cooperate in FIG. 2 to perform the same function. Operation of motor 22, on the other hand, is accomplished by moving valve 54a to its second position and manipulating valve 46a, while valve 54b remains in its normal unactuated position as shown in FIG. 3. In such case, only lines 22a and 22b are exposed to the output lines 50a and 52a of valve 46a, lines 28b and 28a of motor 28 and line 24b of motor 24 being blocked. It will thus be noted that the major difference between the embodiments of FIG. 2 and FIG. 3 is the control valve for controlling the motor unit 22. In FIG. 2 a manually operable control valve 58 connected to the input of valve 46 is utilized for this purpose, whereas in FIG. 3 a servo-operated valve 54a connected to one of the output lines of valve 46a is utilized for this purpose.

FIG. 4 EMBODIMENT

FIG. 4 depicts a further alternative embodiment in which both the valve assembly 30b and the interconnection of the lines of the motors 22, 24 and 28 differ in some respects from the other embodiments. Like the embodiments of FIGS. 2 and 3, a valve 54c is interposed in series in only one of the output lines 50b of a control valve 46b. In two of its three selective positions, the valve 54c performs the same function with respect to motors 24 and 28 as does valve 54 of FIG. 2 and valve 54b of FIG. 3 since, once again, valve 54c has lines 28a and 24a connected thereto separately from one another, while the jointly connected lines 24b and 28b are jointly connected to the other output line 52b of valve 46b. Thus, in the center position of valve 54c as shown in FIG. 4, the movement of valve 46b in either direction will actuate motor 24 by exposing lines 24a and 24b to the output lines 50b and 52b respectively, while one line 28a and 22b of the other motors 28 and 22 are blocked by the valve 54c. Conversely the movement of valve 54c to the position labeled 54c' and the movement of valve 64b in either direction actuates motor 28 by exposing both lines 28a and 28b to output lines 50b and 52b respectively while blocking lines 24a and 22b of the other motors.

The difference between the embodiment of FIG. 4 and those of FIGS. 2 and 3 is therefore again with respect to the control of motor 22, and in this case the difference is twofold. First, of course, the actuation of motor 22 is accomplished by moving the same valve 54c to its third position 54c'' and actuating valve 46b in either direction. Thus no separate third control valve such as 58 of FIG. 2 or 54a of FIG. 3 is required to accomplish this function, but rather only a third position of the series-connected valve 54c. In such third position it will be noted that both lines 22a and 22b are exposed to output lines 50b and 52b respectively, while lines 28a and 24a of the other motors are blocked.

There is a second difference between FIG. 4 and the other embodiments in the interconnection of the fluid lines of the motors 22, 24 and 28. Like the embodiments of FIGS. 2 and 3, each motor 28 and 22 has one of its fluid lines 28b and 22a connected to the valve assembly 30b jointly with a fluid line of motor 24, while its other fluid line 28a and 22b respectively is operatively connected to the valve assembly separately from the fluid lines of the other separately controlled motors. The difference is that the jointly connected fluid lines 28b and 22a are both connected to the same fluid line 24b of motor 24, rather than each being connected to a different fluid line of the motor 24 as in the other embodiments. This arrangement yields the same effective result as do the other embodiments, that is, the number of extensible and retractable fluid lines necessary to conrol three separately controllable double-acting fluid motors is limited to four.

FIG. 5 EMBODIMENT

FIG. 5 shows a further alternative embodiment in which the interconnection of the fluid lines 28b and 24b, and the lines 24a and 22a, with one another at the junctures 36a and 36b respectively is exactly the same as in the embodiments of FIGS. 2 and 3. The arrangement of the valve assembly 30c, however, differs from that of the other embodiments in that the unique series connection of a valve with one, but not the other, of the output lines of another valve is not employed, but rather three separately controllable valves 72, 74 and 76 are employed in parallel relation to one another. In this embodiment valve 72 operates motor 28, valve 74 operates motor 24, and valve 76 operates motor 22. Thus, the movement of valve 72 in either direction exposes lines 28a and 28b of motor 28 to pressurized fluid and exhaust respectively, depending upon the position of the valve 72, while at least one of the fluid lines of the other two motors 22 and 24 are blocked by the other valves 74 and 76. In like manner, the actuation of valve 74 in either direction exposes lines 24a and 24b to pressurized fluid and exhaust respectively while line 28a of motor 28 and line 22b of motor 22 are blocked by the valves 72 and 76 respectively, preventing actuation of those motors. Movement of valve 76 in either direction exposes both lines 22a and 22b to pressurized fluid and exhaust respectively, causing actuation of motor 22 while at least one line of the other two motors 24 and 28 are blocked by valves 72 and 74, thereby preventing actuation of motors 24 and 28. As in the other embodiments, the three separately controlled motors 22, 24 and 28 are controlled with the utilization of only four extensible and retractable lines between the motors and the valve assembly.

From the foregoing explanation it will be appreciated by those skilled in the art that the same principles may be applied to the control of four or more separately controllable double-acting fluid motors, the addition of each motor requiring only the addition of one extensible and retractable fluid line and one additional control valve function. Accordingly, utilizing the principles set forth herein, the number of extensible and retractable fluid lines needed for any higher number of separately controllable double-acting fluid motors can be minimized to the number of such separately controllable motors plus one.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A fluid power system having a source of pressurized fluid and multiple, separately controllable double-acting fluid motors each for selectively performing a different function, said system comprising:
   (a) at least three of said separately controllable double-acting fluid motors, each of said three motors having a respective fluid line means for connecting the respective motor to said source, each of said respective line means comprising a pair of fluid lines operatively connected separately to the respective motor;
   (b) selectively operable fluid control valve means operatively connected between said source and said respective fluid line means for receiving fluid from said source and delivering said fluid selectively to said fluid lines;
   (c) each of two of said motors having one of its fluid lines operatively connected to said valve means jointly with a fluid line of the third motor, and having the other of its fluid lines operatively connected to said valve means separately from the fluid lines of the other ones of said motors, the fluid lines of the third motor being operatively connected to said valve means separately from one another.

2. The system of claim 1 wherein each of said two motors has one of its fluid lines operatively connected to said valve means jointly with a respective different one of the fluid lines of said third motor.

3. The system of claim 1 wherein each of said two motors has one of its fluid lines operatively connected to said valve means jointly with the same fluid line of said third motor.

4. The system of claim 1 including a lift truck for mounting said fluid power system thereon, said lift truck having a main body upon which said valve means is mounted and a load handling attachment upon which said three motors are mounted, said load handling attachment being movably mounted upon said main body so as to reciprocate vertically with respect thereto, further including connecting means for interconnecting the respective ones of said fluid lines which are operatively jointly connected with one another to said valve means, said connecting means being mounted in association with said load handling attachment for reciprocating vertically in response to the vertical reciprocation of said load handling attachment.

5. The system of claim 1 including pilot operated valve means, disposed in one fluid line which is operatively connected to said valve means jointly with another fluid line and interposed at a location between the motor having said one line and the junction of the jointly connected fluid lines, said pilot operated valve means being responsive to the pressure of fluid in the other of the pair of fluid lines connected to that motor for preventing the exhaust of fluid from that motor through the fluid line containing the pilot operated valve means whenever the pressure of fluid in the other of said pair of fluid lines connected to that motor is below a predetermined pressure, while concurrently permitting the exhaust of fluid through the other jointly connected fluid line.

6. The system of claim 1 including vented pilot operated valve means, disposed in one fluid line which is operatively connected to said valve means jointly with another fluid line and interposed at a location between the motor having said one line and the junction of the jointly connected fluid lines, said vented pilot operated valve means being responsive to the pressure of fluid in the other of the pair of fluid lines connected to that motor for preventing the supply of pressurized fluid to that motor through the fluid line containing the vented pilot operated valve means whenever the pressure of fluid in the other of said pair of fluid lines connected to that motor exceeds a predetermined pressure, while concurrently permitting the supply of pressurized fluid through the other jointly connected fluid line.

7. A fluid power system having a source of pressurized fluid and multiple, separately controllable double-acting fluid motors each for selectively performing a different function, said system comprising:

(a) first selectively operable fluid control valve means, for controlling said motors, having input line means for receiving fluid from said source and respective first and second output lines for selectively delivering said fluid to a respective one of said motors while simultaneously exhausting fluid therefrom;

(b) second selectively operable fluid control valve means, for controlling said motors, operatively connected in series with the first output line, but not the second output line, of said first control valve means;

(c) a pair of said motors, each having respective first and second fluid lines connected separately thereto, the first fluid lines of said respective motors being operatively connected separately from one another to said second control valve means, and the second fluid lines of said respective motors being operatively connected jointly to the second output line of said first control valve means;

(d) a third double-acting fluid motor having respective first and second fluid lines connected separately thereto, the first fluid line of said third motor being operatively connected to one of said first and second control valve means jointly with a fluid line of at least one of said pair of motors; and (e) third selectively operable fluid control valve means, controllable separately from said one of said first and second control valve means, operatively connected to the second fluid line of said third motor for controlling the flow of fluid therein.

8. The system of claim 7 wherein the first fluid line of said third motor is operatively jointly connected with one of the first fluid lines of said pair of motors.

9. The system of claim 8 wherein said fluid control valve means for said third motor comprises a third fluid control valve means separate from said first and second fluid control valve means.

10. The system of claim 9 wherein said third fluid control valve means is operatively connected to said input line means of said first fluid control valve means.

11. The system of claim 9 wherein said third fluid control valve means is operatively connected to said second output line of said first fluid control valve means.

12. The system of claim 7 wherein the first fluid line of said third motor is operatively jointly connected with said second fluid lines of both of said pair of motors.

13. The system of claim 7 including control means for selectively operating said respective first and second control valve means separately from, and simultaneously with, one another.

14. The system of claim 13 wherein said control means comprises manually powered means for selectively operating said first control valve means and electrically powered means for selectively operating said second control valve means, said electrically powered means including electrical switch means mounted upon said manually powered means for selective actuation simultaneously therewith.

15. The system of claim 7 including a lift truck for mounting said fluid power system thereon, said lift truck having a main body upon which said first, second and third fluid control valve means are mounted and a load handling attachment upon which said motors are mounted, said load handling attachment being movably mounted upon said main body so as to reciprocate vertically with respect thereto, further including connecting means for operatively connecting the second fluid lines of said respective pair of fluid motors jointly with one another and for connecting the first fluid line of said third motor to a fluid line of at least one of said pair of motors, said connecting means being mounted in association with said load handling attachment for reciprocating vertically in response to the vertical reciprocation of said load handling attachment.

16. A fluid power system having a source of pressurized fluid and multiple, separately controllable double-acting fluid motors each for selectively performing a different function, said system comprising:

(a) first selectively operable fluid control valve means, for controlling said motors, having input line means for receiving fluid from said source and respective first and second output lines for selectively delivering said fluid to a respective one of said motors while simultaneously exhausting fluid therefrom;

(b) second selectively operable fluid control valve means, for controlling said motors, operatively connected in series with the first output line, but not the second output line, of said first control valve means;

(c) a pair of said motors, each having respective first and second fluid lines connected separately thereto, the first fluid lines of said respective motors being operatively connected separately from one another to said second control valve means, and the second fluid lines of said respective motors being operatively connected jointly to the second output line of said first control valve means; and (d) a third double-acting fluid motor having respective first and second fluid lines connected separately thereto, the first fluid line of said third motor being operatively connected to said first control valve means jointly with said second fluid lines of said pair of motors, and said second fluid line of said third motor being operatively connected to said second control valve means separately from said first fluid lines of said first and second motors respectively for controlling the flow of fluid in said third motor.

17. A fluid power system having a source of pressurized fluid and multiple, separately controllable double-acting fluid motors each for selectively performing a different function, said system comprising:

(a) first selectively operable fluid control valve means, for controlling said motors, having input line means for receiving fluid from said source and respective first and second output lines for selectively delivering said fluid to a respective one of said motors while simultaneously exhausting fluid therefrom;

(b) second selectively operable fluid control valve means, for controlling said motors, operatively connected in series with the first output line, but not the second output line, of said first control valve means;

(c) a pair of said motors, each having respective first and second fluid lines connected separately thereto, the first fluid lines of said respective motors being operatively connected separately from one another to said second control valve means, and the second fluid lines of said respective motors being operatively connected jointly to the second output line of said first control valve means; and (d) pilot operated valve means interposed in the second fluid line of at least one motor of said pair of motors and responsive to the pressure of fluid in the first fluid line of the same motor, for preventing the exhaust of fluid from said one motor through the second fluid line thereof whenever the pressure of fluid in the first fluid line thereof is below a predetermined pressure while concurrently permitting the exhaust of fluid from the other motor of said pair of motors through the second fluid line of the other motor.

* * * * *

UNITED STATES PATENT AND TRADEMARK OFFICE

CERTIFICATE OF CORRECTION

PATENT NO. : 4,161,256

DATED : July 17, 1979

INVENTOR(S) : Richard D. Seaberg

It is certified that error appears in the above-identified patent and that said Letters Patent are hereby corrected as shown below:

| | | | |
|---|---|---|---|
| Col. 1, | line 45 | Change "more" to --move--. |
| Col. 5, | line 24 | Change "load-fitting" to --load-lifting--. |
| Col. 6, | line 5 | Change "more" to --move--. |
| Col. 9, | line 17 | Change "motor 32" to --motor 22--. |
| Col. 11, | line 2 | Change "valve 64b" to --valve 46b--. |
| | line 51 | Change "Thus," to --Thus--. |

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*